United States Patent [19]

Ito et al.

[11] Patent Number: 4,952,983

[45] Date of Patent: Aug. 28, 1990

[54] MULTI-COLORED IMAGE FORMING APPARATUS

[75] Inventors: Masazumi Ito; Kadotaro Nishimori; Kimihiko Higashio, all of Osaka, Japan

[73] Assignee: Minolta Camera Kabushiki Kaisha, Osaka, Japan

[21] Appl. No.: 400,004

[22] Filed: Aug. 29, 1989

[30] Foreign Application Priority Data

Aug. 30, 1988 [JP] Japan ..... 63-215757

[51] Int. Cl.[5] ..... G03G 15/01

[52] U.S. Cl. ..... 355/328; 355/245; 355/77

[58] Field of Search ..... 355/200, 218, 245, 327, 355/328, 77, 326

[56] References Cited

U.S. PATENT DOCUMENTS 3,914,043 10/1975 McVeigh .
4,814,824 3/1989 Ito et al. .
4,862,216 8/1989 Higashi et al. ..... 355/328 X
4,862,219 8/1989 Yoshida et al. ..... 355/218 X
4,884,096 11/1989 Kusuda et al. ..... 355/328 X
4,885,611 12/1989 Higashio et al. ..... 355/328 X

*Primary Examiner*—R. L. Moses

*Attorney, Agent, or Firm*—Burns, Doane, Swecker & Mathis

[57] ABSTRACT

An image forming apparatus for conducting a different manner of copy process for each of a plurality of regions which are subdivided from one original document. The image forming apparatus includes a plurality of levers for assigning boundaries of each region and a specifying device for specifying the number of regions and pattern of the copy process executed in each region. At least one of the plurality of designating levers are invalidated so as to achieve agreement between the number of the regions specified by the specifying device and the number of the regions subdivided by the designating levers when these numbers do not agree.

20 Claims, 13 Drawing Sheets

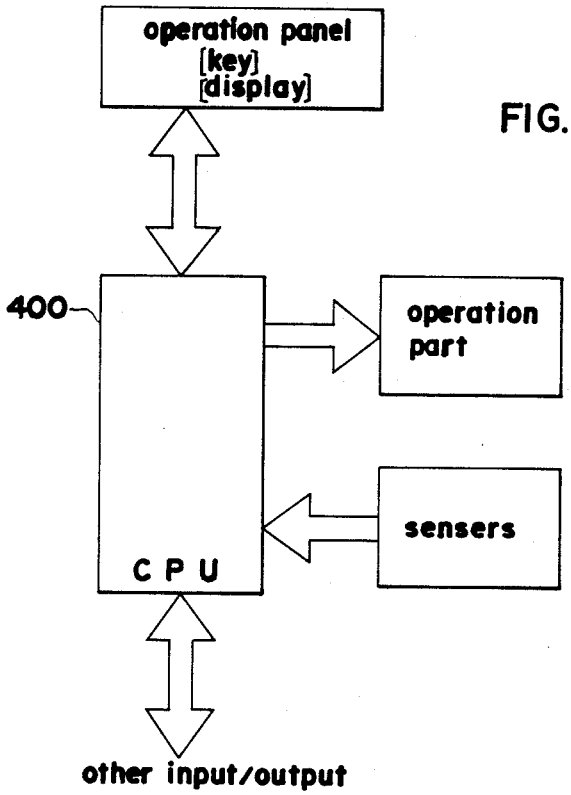
FIG.5
FIG.6
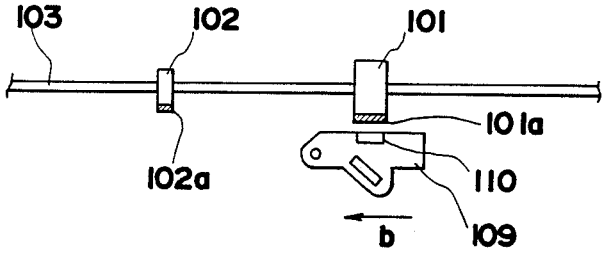

MULTI-COLORED IMAGE FORMING APPARATUS

BACKGROUND OF THE INVENTION

1. Field of the Invention

The present invention relates to a multi-colored image forming apparatus which provides a multi-colored copy of an original document.

2. Description of Related Arts

One type of known multi-colored image forming apparatus is disclosed in U.S. Pat. No. 3,914,043.

This invention relates to a copier capable of forming multi-colored images in a single-cycle image forming process by controlling the operational timing of a plurality of developing units each of which contain different color toners.

The single-cycle image forming process wherein the copy mode executes multi-colored image formation shall hereinafter be referred to as the "simul-color mode."

The simul-color mode is first selected by means of a simul-color color mode key. Then, the original document image region is subdivided into a plurality of smaller regions, and developing material colors are assigned to correspond to the respective subdivided smaller regions, thereby specifying the pattern of the simul-color mode.

When the copy function is executed after the simul-color mode pattern has been specified, the charging, exposure and transfer processes are all executed in exactly the same manner as in a normal copy operation. The developing process, however, is executed by switching among the developing units with specific timing in accordance with the smaller regions and the developing colors corresponding to said smaller regions.

The effect of the aforesaid process enables the multi-colored developing in a single-cycle image forming process.

As previously mentioned, setting the simul-color mode is accomplished after the simul-color mode is selected by assigning the individual small regions and the individual developing colors corresponding to said small regions.

The aforesaid small regions are subdivided by boundary lines oriented perpendicular to the document scanning direction.

A simul-color mode copy is frequently accomplished with two or three individual small regions.

Also, the developing colors corresponding to each of the small regions is generally constant.

That is, the simul-color mode pattern is most prevalent in one of the following: Patterns <1> Color/Black <2> Black/Color in the case of two small regions, or <3> Color/Black/Color <4> Black/Color/Black in the case of three small regions.

Therefore, the aforesaid mode patterns <1> through <4> can be conveniently assigned by a simple key operation.

On the other hand, assigning three small regions (small regions subdivided by boundary lines perpendicular to the document scanning direction) may be accomplished, for example, as shown in FIG. 3, by providing two levers 101 and 102 in proximity to the document platen so that both said levers are adjustable to desired positions. Such an arrangement is disclosed in U.S. patent application No. 148,423 applied for by the present applicant.

The present invention is designed to eliminate the problems produced by assigning the small regions by means of the aforesaid two lever arrangement, and assigning the previously described simul-color mode patterns <1> through <4> by means of a simple key operation, or any combination thereof.

The aforesaid problems occur when a two-region mode pattern (mode pattern 1 and mode pattern 2) is specified by a key operation although three regions are specified by the aforesaid lever arrangement.

SUMMARY OF THE INVENTION

Accordingly, a main object of the present invention is to provide a superior multi-colored image forming apparatus capable of eliminating the aforesaid disadvantages.

A further object of the present invention is to provide a multi-colored image forming apparatus capable of assigning the small regions for the simul-color mode pattern, and assigning the developing colors corresponding to each of the small regions by means of a simple operation.

These and other objects are attained by a copier capable of executing different copy processing for different regions of a single original document, said copier having a plurality of designating means for assigning the boundaries of each region perpendicular to the document scanning direction so as to subdivide an original document into a plurality of regions, a specifying means for specifying the number of regions and the pattern of the copy process executed in each region, and a means for invalidating several of the plurality of designating means so as to achieve agreement between the number of regions specified by the specifying means and the number of the regions subdivided by the designating means when these numbers do not agree.

More specifically, the aforesaid separate copy processing is the process of reproducing each region with a different color developing material. In addition, the aforesaid designating means is a lever provided at the edge of the document platen so as to be slidable in the document scanning direction.

BRIEF DESCRIPTION OF THE DRAWINGS

These and other objects or features of the present invention will become apparent from the following description of a preferred embodiment thereof taken in conjunction with the accompanying drawings, in which:

FIG. 5 is a block diagram showing the control circuit of the aforesaid copier.

FIG. 6 is an illustration showing the detector mechanism for detecting the position of the levers used to designate the small region.

In the following description, like parts are designated by like reference numbers throughout the several drawings.

DESCRIPTION OF THE PREFERRED EMBODIMENT

The preferred embodiments of the present invention are described in detail hereinafter with reference to the accompanying drawings.

Figure 1:
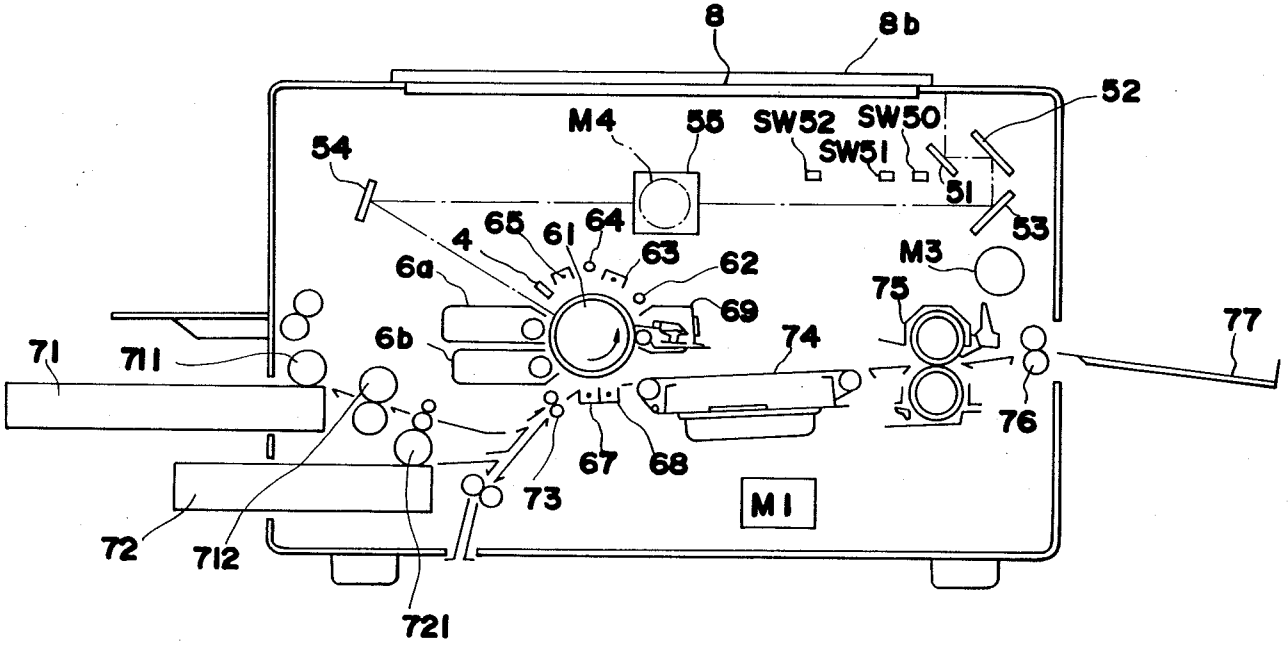
FIG. 1 is a section view of a copier provided with a simul-color mode of the present invention.

FIG. 1 is a section view showing the construction of the copier provided with an embodiment of the present invention.

In the copier shown in the drawing, an optical unit is provided in the upper portion of the copier and an image forming section is provided in the lower portion of the copier.

Paper trays are disposed on the left side of the copier in the drawing.

(i) Optical System

An optical unit scans and exposes an original document arranged upon document platen 8, and form an image on the surface of a photoconductive drum 61 with the image reflected from the surface of said original document.

The optical unit comprises an exposure lamp (not shown in the drawings), reflecting mirrors 51, 52, 53 and 54, and a lens 55. The exposure lamp and reflecting mirror 51 are driven at a speed V/N (where V is the circumferential speed of photoconductive drum 61, and N is the copy magnification), and reflective mirrors 52 and 53 are driven at a speed V/2N by a motor M3 so as to reciprocally travel along the bottom surface of document platen 8. The original document exposure scan is accomplished during the aforesaid reciprocating movement. Item **8*b*** in the drawing is a document cover.

Copy magnification is set by adjusting the position of lens 55 and reflecting mirror 54. The image forming position can be corrected by angular adjustment of reflecting mirror 54. The aforesaid positional adjustments are accomplished by means of a drive motor M4.

Switches SW50, SW51 and SW52 are sensors for detecting the positions of the moving members of the optical system.

(ii) Image Forming Section

The image forming section forms images by means of an electrophotographic process. That is, the electrostatic latent image formed on the surface of the photoconductive drum 61 is developed with toner, and the toner image is transferred onto a copy sheet and fused thereon before the sheet is discharged from the copier.

The image forming section is constructed with the photoconductive drum 61 at its center, said drum being supported so as to be rotatable in the counterclockwise direction in the drawing.

The photoconductive drum 61 has arranged around its periphery eraser lamps 62 and 64, chargers 63 and 65, image interval eraser 4, developing units **6*a* and 6*b*, transfer charger 67, separation charger 68, and a cleaning device 69. The first developing device 6*a* contains color toner, and the second developing device 6*b*** contains black toner.

After the copy sheet is selectively taken from paper tray 71 or paper tray 72, said sheet is taken up by timing roller set 73 with a specific timing, and thereafter transported between the photoconductive drum and the transfer charger. Subsequently, the used copy sheet is transported by a transport belt 74 to a fixing device 75 where the toner image is fixed, and the sheet is thereafter discharged by discharge roller set 76 to a discharge tray 77. The main motor is designated M1 in the drawing.

(iii) Paper Tray Section

The paper tray section comprises top paper tray 71 and bottom paper tray 72 which contain paper of different sizes.

The paper accommodated within tray 71 is output by take-up roller 711 and transported to timing roller set 73 by roller set 712. On the other hand the paper accommodated within tray 72 is output by take-up roller 721 and transported to timing roller set 73.

Thereafter, the sheet is transported between the photoconductive drum 61 and transfer charger 67 synchronously with the rotation of photoconductive drum 61 and in accordance with a specific timing signal output from the optical unit, whereupon the toner image is transferred to the sheet.

[Description of Simul-color Mode]

Figure 7:
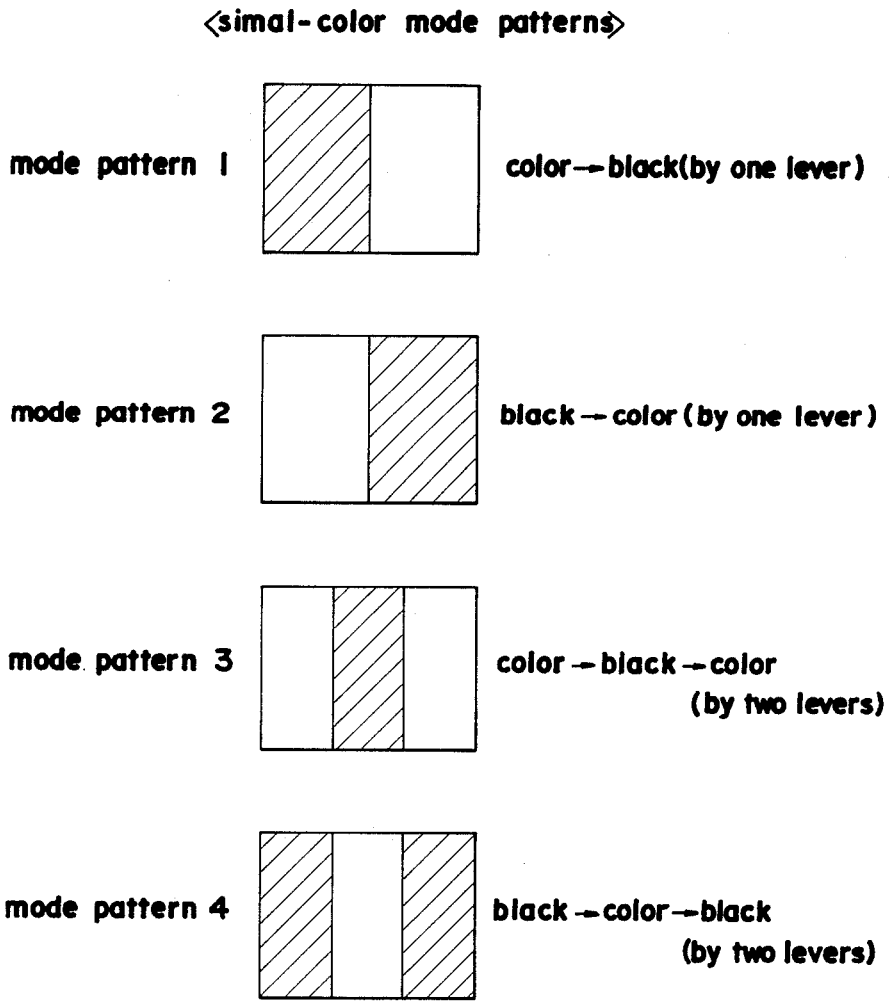
FIG. 7 is an illustration showing the mode pattern for reproducing in the simul-color mode.

FIG. 7 is an illustration of the simul-color mode patterns set in the copier of the present embodiment.

The simul-color modes include three-region subdivision modes (mode pattern 3 and mode pattern 4), and two-region subdivision modes (mode pattern 1 and mode pattern 2).

The various mode patterns are as follows:

Mode pattern 1

(two-region subdivision): Color →Black

Mode pattern 2

(two-region subdivision): Black →Color

Mode pattern 3

(three-region subdivision): Color →Black →Color

Mode pattern 4

(three-region subdivision): Black →Color →Black

When a two-region subdivision mode is specified in the present invention, lever 102 specifications are ignored through controls and regions B and C are combined.

[Description of Operation panel]

Figure 4:
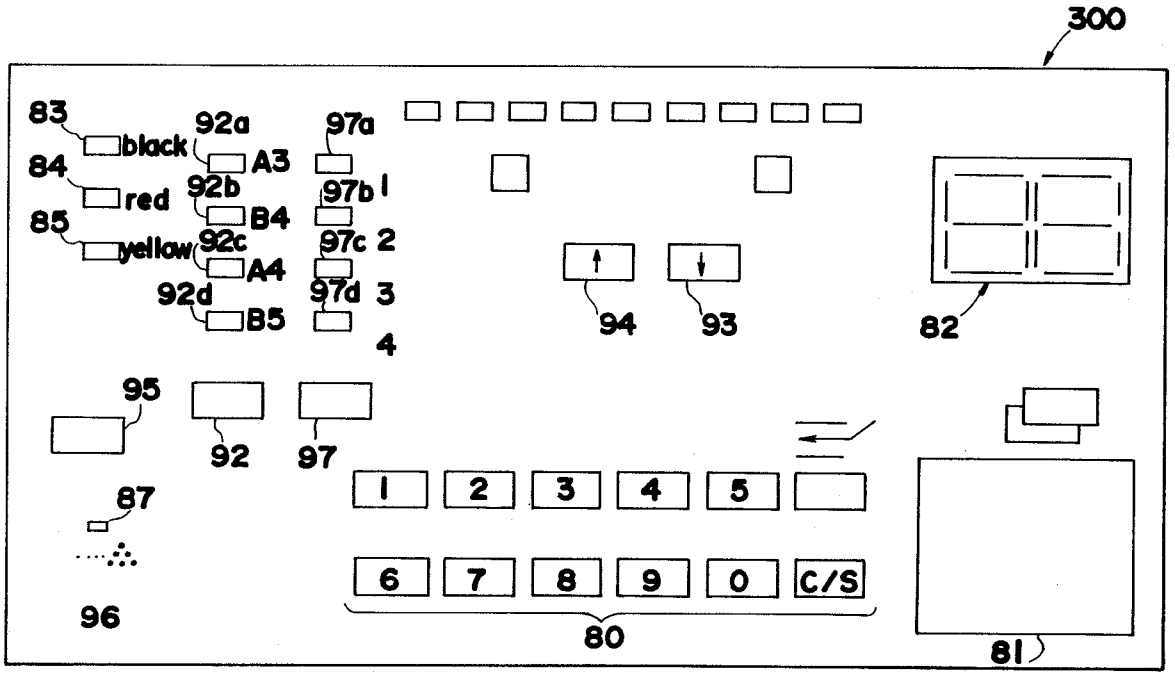
FIG. 4 is a top plan view showing the operation panel of the aforesaid copier.

FIG. 4 is a top plan view of the operation panel of the previously described copier. On panel 300 in the drawing are arranged an INTERRUPT KEY for enabling the command to interrupt the copy, a CLEAR/STOP KEY, TEN-KEY PAD 80 for entering the copy number and the like, PRINT KEY 81 for enabling the command to start printing, PAPER SELECTION KEY 92 for selecting paper size, paper selection indicator LEDs 92*a*, 92*b*, 92*c* and 92*d*, COPY DENSITY UP/DOWN KEYS 93 and 94 for increasing and decreasing copy density, display portion 82 for segment display of the copy number and the like, SIMUL-COLOR SELECT KEY 97 for selecting simul-color modes (mode patterns 1 through 4), simul-color mode selection display LEDs 97*a*, 97*b*, 97*c* and 97*d* for indicating the selected simul-color mode, COLOR SELECT KEY 95 for selecting developing color, color selection display LEDs 83, 84 and 85 for indicating the selected developing color, and TONER EMPTY display LED 87 for indicating low toner supply.

Figure 2:
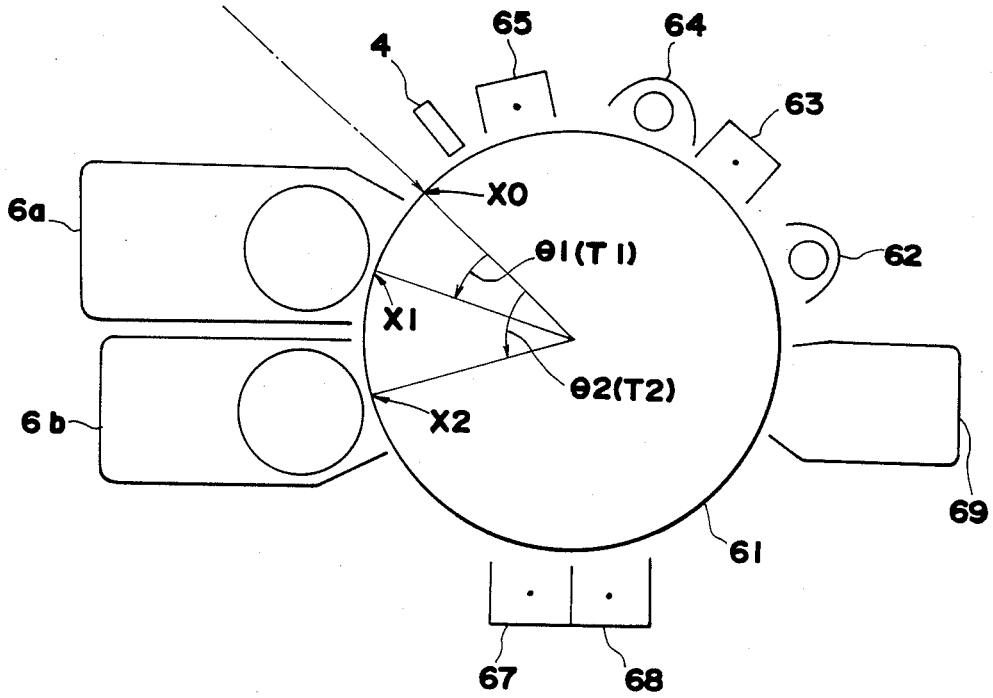
FIG. 2 is an illustration to explain the switching timing of the developing devices.

[Description of Developing Timing] FIG. 2 is an illustration of the timing for developing device switching during simul-color copying.

The light image reflected from the optical unit is projected onto the photoconductive drum 61 at a position on the upper left side (exposure position X0), as shown in FIG. 2, so as to form an electrostatic latent image on the surface of said photoconductive drum 61 in accordance with the image data.

In the drawing, the developing point (the point at which the toner on the surface of the developing sleeve travels toward the photoconductive drum 61) of the first developing device 6*a* is designated X1 and the second developing point of developing device 6*b* is designated X2.

When the positions of the aforesaid two developing points are expressed relative to the previously mentioned exposure light position X0, point X1 is expressed as angle $\theta 1$ at time T1, and point X2 is expressed as angle $\theta 2$ at time T2. Time T1 (or time T2) is the time required for an arbitrary point on the surface of photoconductive drum 61, which travels at a specified speed, to travel from the exposure light position X0 and arrive at the developing point X1 (or point X2).

Simul-color developing is made possible by controlling the operational timing of each developing device in accordance with the aforesaid times T1 and T2, lever position detection signals (described later) defining the boundaries of the small subdivisions, and the set simul-color mode pattern.

[Simul-color Region Setting Mechanism]

Figure 3:
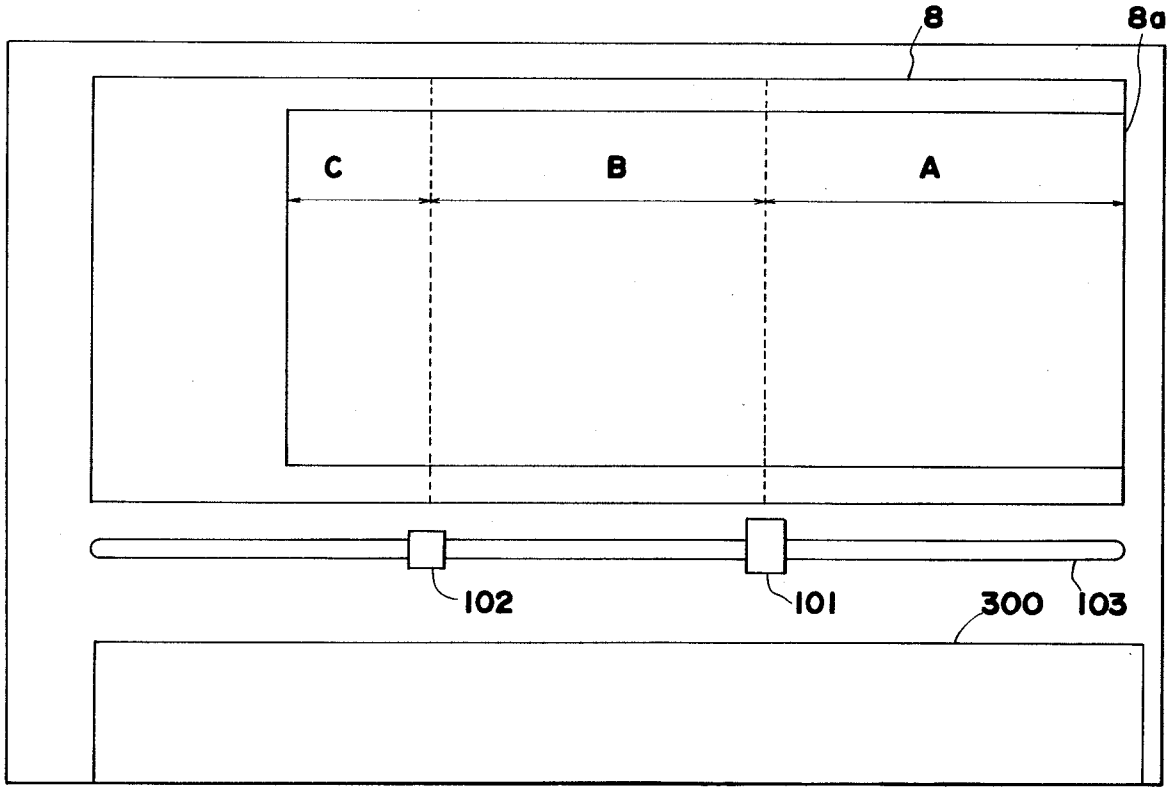
FIG. 3 is a top plan view of the document platen and its peripheral portion in the aforesaid copier.

FIG. 3 is a top plan view of the document platen and its peripheral portion in the aforesaid copier. As shown in the drawing, a guide channel 103 is formed along the scanner travel direction (left to right in the drawing) between the operation panel and document glass platen 8 on the operator's side (at the bottom of the drawing). A first lever 101 and a smaller second lever 102 are slidably arranged in the aforesaid guide channel 103.

When the simul-color mode is selected, the small region subdivisions can be designated by means of the aforesaid two levers.

That is, the image region of original document 8*a* positioned on document platen 8 is subdivided into the three sections A, B and C as described below.

Region A: Front edge of document platen to first lever 101.

Region B: First lever 101 to second lever 102.

Region C: Second lever 102 to trailing edge of document.

When a two-region subdivision mode (mode patterns 1 or 2) is set by means of the simul-color select key 97, lever 102 is ignored as previously mentioned, so that region B and C are combined into a single region.

The first lever 101 and second lever 102 are functionally somewhat different and, therefore, are of different sizes in the present embodiment. The differences between the two levers may be lever color, configuration or some other means.

During the copy operation the operation of the developing devices is controlled at the boundaries of each of the regions designated as described so as to switch the copy image colors.

The timing for switching each developing device during a single copy process of each mode pattern is illustrated in specifically in FIG. 7. Mode pattern 1 and mode pattern 3 are compared herein. When mode pattern 3 is designated, a reed switch 110 generates a detection signal by the second lever 102, and when the second such detection signal is detected the first developing device is again switched ON. When mod e pattern 1 is designated, the second detection signal is ignored.

Figure 11:
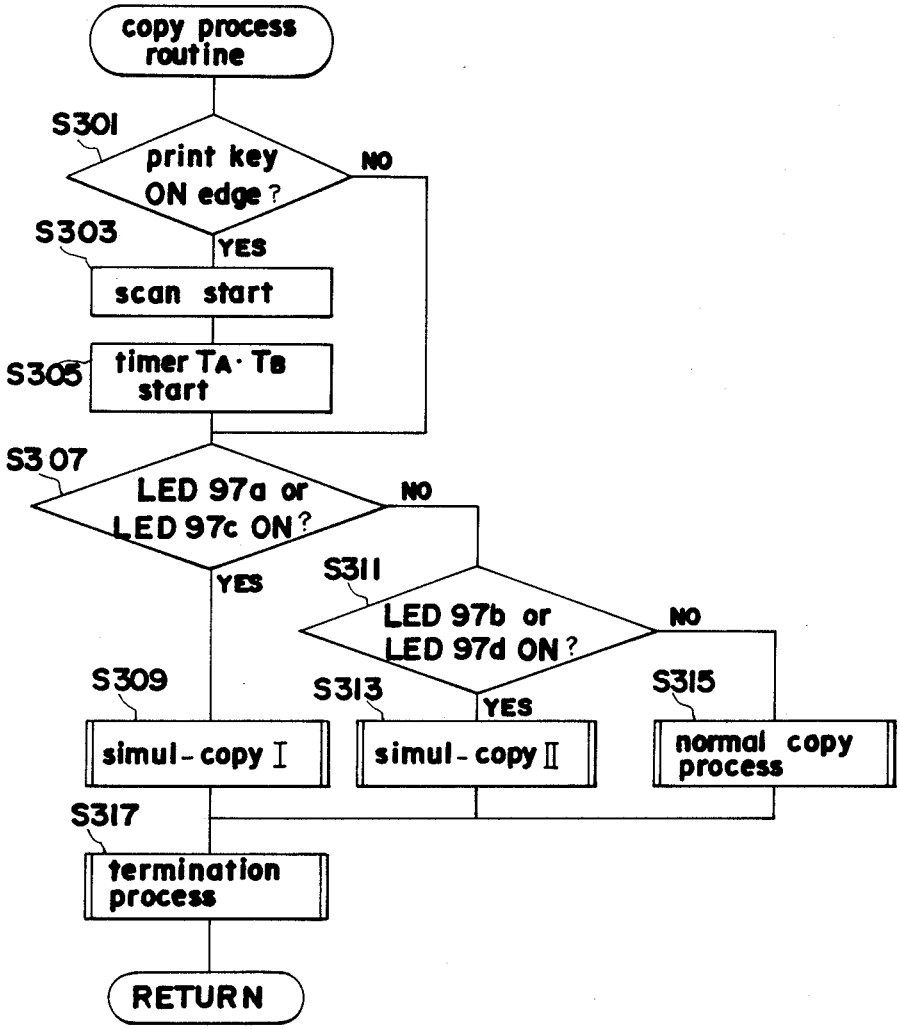
FIG. 11 is a flow chart for the copy process routine.

Mode pattern 4 and mode pattern 2 are identical to the previous description. The timing control shown in the timing chart in FIG. 11 is provided by a control CPU (central processing unit) described later, so that each mode pattern can be discriminated by means of the lighted state of LEDs 97*a* through 97*d*.

[Lever Position Detecting Mechanism]

FIG. 6 illustrates the lever position detecting mechanism in the copier.

Beneath the first lever 101 and second lever 102 disposed within the aforesaid guide channel 103 are formed magnets 101*a* and 102*a* integrated as a single unit.

Magnetic reed switch 110 is disposed at a specified position (a position which may confront magnet 101*a* and 102*a*) of scanner 109 provided with the exposure lamp and reflecting mirror 51. During the scan (in the arrow "b" direction in the drawing) a lever detection signal is generated at the precise instant scanner 109 passes beneath each lever, said signal being output to the control CPU described later.

[Control Circuit]

FIG. 5 is a block diagram showing the construction of the control circuit for the previously described copier.

The control circuit is constructed around control CPU 400, as shown in the drawing.

Signals from the aforesaid magnetic reed switch 110 sensors and operation panel key switches are input to control CPU 400.

Drive control signals are transmitted from the control CPU 400 to the operation part to drive each component in the copier, and drive control signals are output from CPU 400 to each of the display elements on the operation panel.

In addition to the aforesaid, other peripheral circuits are connected to control CPU 400, and both peripheral circuits and control CPU 400 mutually transmit data continuously to execute control of the copier.

[CPU Processing]

The operation of the device of apparatus of the present embodiment is described hereinafter according to the processing of control CPU 400. In the following description ON EDGE specifies the change when the signal state switches from the OFF state to the ON state.

Figure 8:
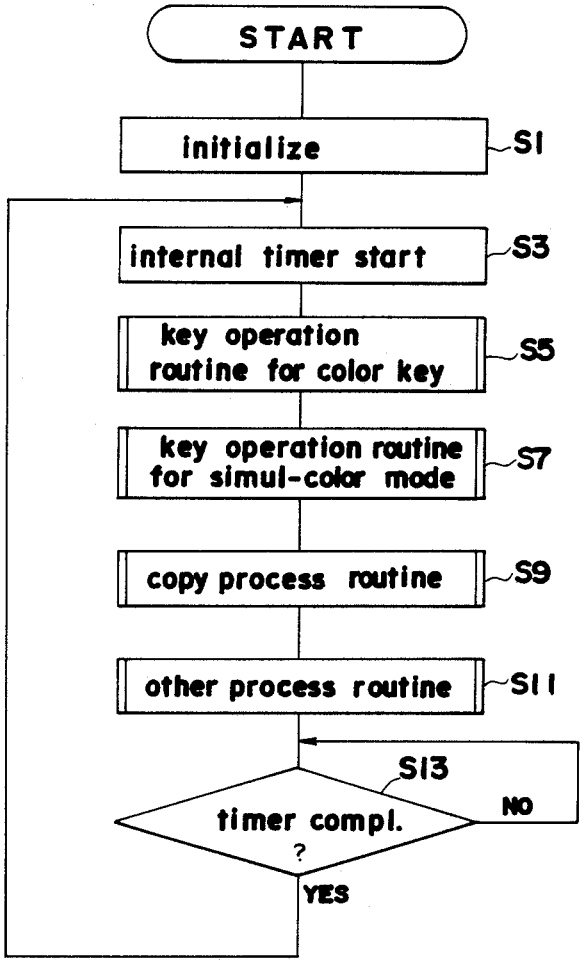
FIG. 8 is a flow chart of the main routine for copy function control.

FIG. 8 is a flow chart showing the main routine of the control CPU 400 processing.

Control CPU 400 starts processing when, for example, the power is switched ON, and each register and flag is initialized in step S1.

In step S3, an internal timer is started to define the time of one routine.

In step S5, the color key process routine which controls the color copy mode is executed in correspondence with the ON EDGE status of color key 95, and in step S7 the simul-color key process routine which controls the simul-color mode is executed in correspondence with the ON EDGE status of simul-color select key 95.

The copy operation routine which controls the copy operation is executed in step S9. In step S11, other processing is executed, the details of said other processing being commonly known and are omitted herein.

The completion of the internal timer started step S3 is awaited, and when said timer completes its cycle the program returns to step S3.

The color process routine in step S5, simul-color key process routine in step S7, and copy operation routine in step S9 are described in detail hereinafter.

Figure 9:
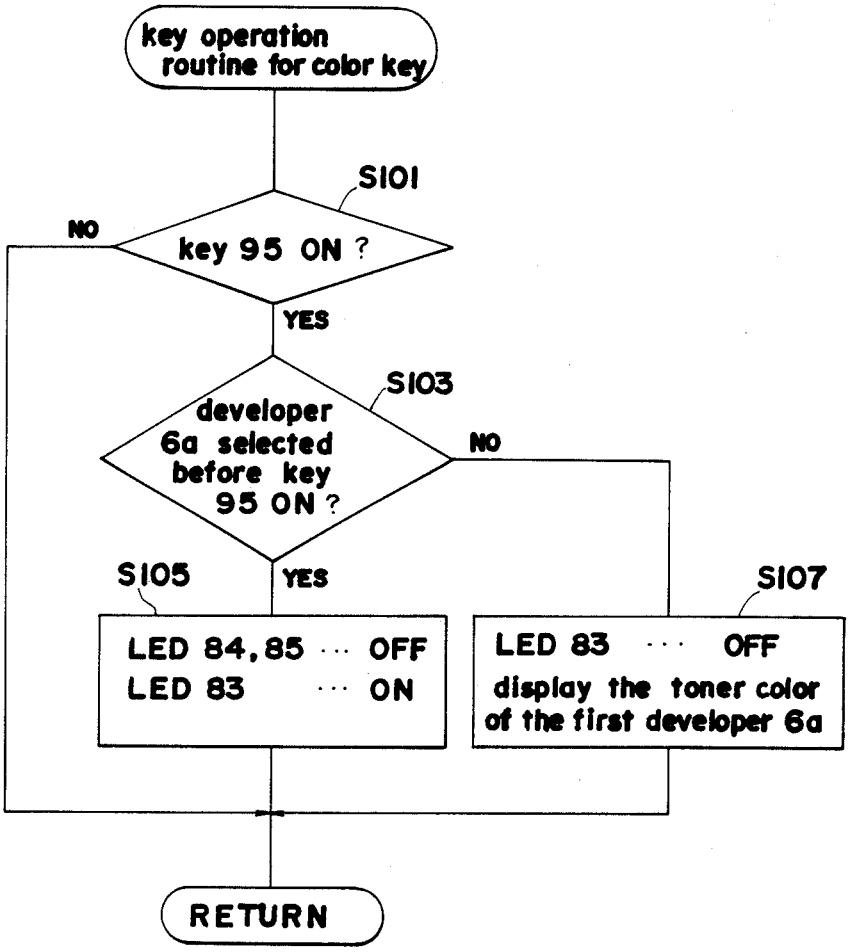
FIG. 9 is a flow chart of the key operation routine for color keys.

FIG. 9 is a flow chart showing the process of the color key process routine in step S5.

First, in step S101, a determination is made as to whether or not the color key 95 is ON EDGE.

When the sensors indicate that color key 95 is not ON EDGE (i.e., when the result in step S101 is NO), the routine jumps steps S103 through S107 to return to the main routine.

When the sensors indicate that color key 95 is ON EDGE in step S101 (i.e., when the result in step S101 is YES), the routine progresses to step S103. In step S103 a determination is made as to whether or not the first developing device **6*a* (color developing device) was selected as the developing device prior to the detection of the ON EDGE status of the aforesaid color key 95. This determination is made by discriminating whether LED 84 or LED 85** is switched ON.

When the result obtained in step S103 specifies the first developing device **6*a* (color developing device) has been selected (i.e., when the result in step S103 is YES), the color select LED 84 (red) and LED 85 (yellow) are switched OFF, and the color select LED 83 (black) is switched ON in step S105. That is, the second developing device 6*b*** (black developing device) is selected and black is set as the copy color.

When the determination in step S103 specifies the first developing device **6*a* (color developing device) was not selected prior the detection of the ON EDGE status of color key 95 (i.e., when the result obtained in step S103 is NO), the color select LED 83 (black) is switched OFF, and a color select LED (either LED 84 (red) or LED 85 (yellow)) is switched ON in step S107 in accordance with the toner color set in the first developing device 6*a*. That is, the first developing device 6*a*** (color developing device) is selected, and either red or yellow is set as the copy color. The first developing device is provided a code corresponding to a color, so that the color of said first developing device can be known when the aforesaid code is detected.

The program returns to the main routine following the processing sequence described above. The color key process routine is not executed when a simul-color mode pattern 1 through 4 is selected (i.e., when LED **97*a*, 97*b*, 97*c* or 97*d* is selected). In other words, input from color select key 95** is not accepted.

Simul-color Process Routine in Step S7

Figure 10:
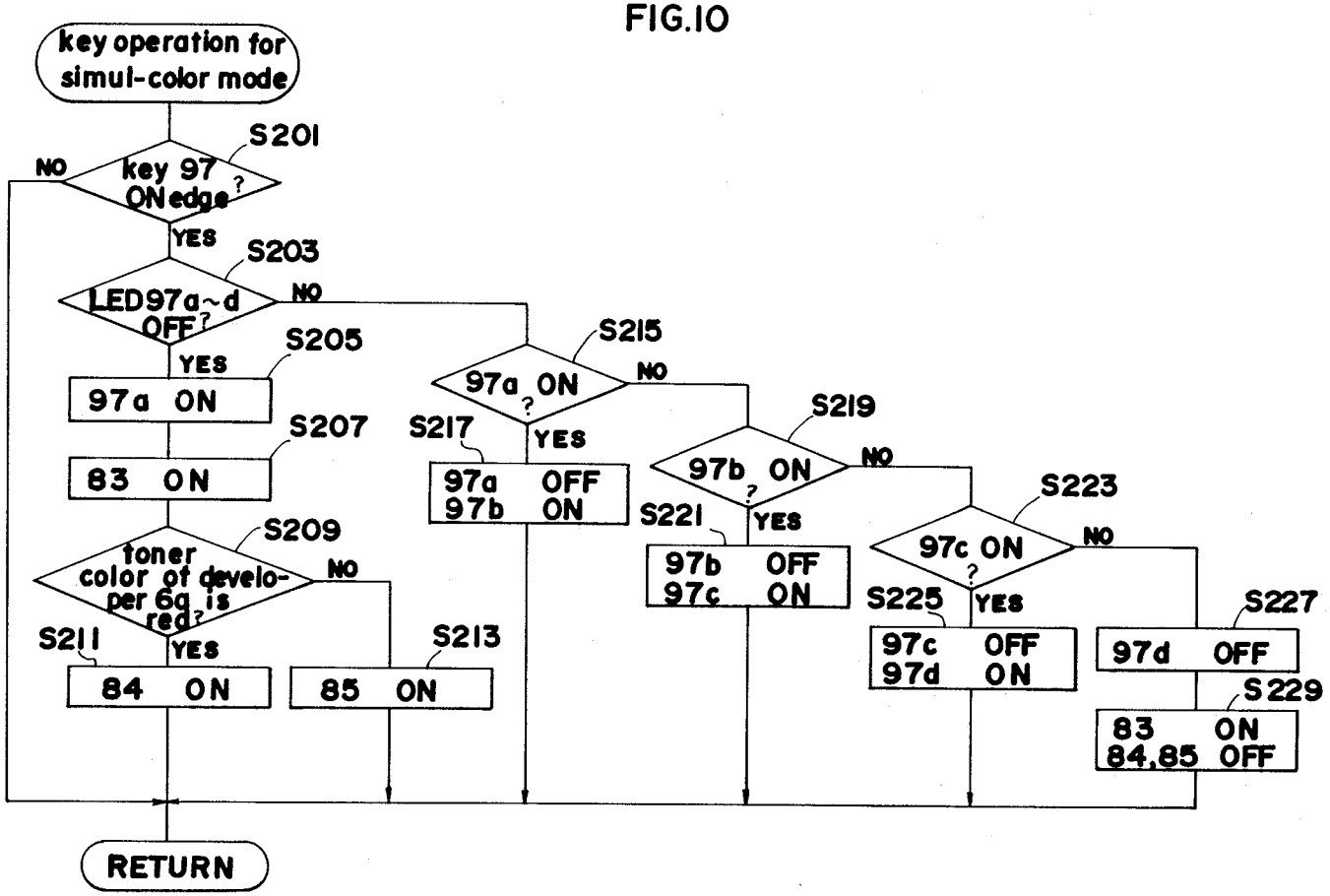
FIG. 10 is a flow chart of the key operation for the simul-color mode.

FIG. 10 is a flow chart showing the process of the simul-color process routine in step S7.

First, in step S201, a determination is made as to whether or not the simul-color select key 97 is ON EDGE.

When the ON EDGE status of simul-color select key 97 is not detected in step S201 (i.e., when the result obtained in step S201 is NO), the routine jumps steps S203 through S229 and returns to the main routine.

If the simul-color select key 97 is found to be ON EDGE in step S201, the routine progresses to step S203 and a determination is made as to whether or not all the simul-color mode select display LEDs **97*a* through 97*d*** are switched OFF.

When it is found in step S203 that all simul-color mode select display LEDs **97*a* through 97*d* are OFF (i.e., when the result obtained in step S201 is YES), the simul-color mode select display LED 97*a* is switched ON in step S205, and simul-color mode pattern 1 is selected (refer to FIG. 7). Thereafter, the color select display LED 83 (black) is switched ON in step S207 and, in accordance with the toner color accommodated in the first developing device 6*a* (determined in step S209), the color select display LED 84 (red) or LED 85 (yellow) is switched ON (in step S211 or S213** respectively).

When the check made in step S203 leads to the determination that not all the simul-color mode select display LEDs **97*a* through 97*d* are OFF, in other words, when it is determined that one of the display LEDs 97*a* through 97*d* is ON (i.e., when the result obtained in step S203 is NO), the simul-color mode select display LED 97*a* is found to be conditionally set ON (result obtained in step S215 is YES), so that said simul-color mode select display LED 97*a* is switched OFF and simul-color mode display LED 97*b* is switched ON in step S217**. In other words, the simul-color mode pattern 2 (refer to FIG. 7) is selected.

If it is determined in step S215 that the simul-color mode select LED **97*a* is OFF (i.e., if the result obtained in step S215 is NO), it is found that simul-color mode select LED 97*b* is found to be conditionally set ON (i.e., the result obtained in step S219 is YES), and said simul-color mode select display LED 97*b* is switched OFF and simul-color mode select LED 97*c* is switched ON in step S221**. That is, simul-color mode pattern 3 (refer to FIG. 7) is selected.

Similarly, if it is determined in step S219 that the simul-color mode select LED **97*b* is OFF (i.e., if the result obtained in step S219 is NO), it is found that simul-color mode select LED 97*c* is found to be conditionally set ON (i.e., the result obtained in step S223 is YES), and said simul-color mode select display LED 97*c* is switched OFF and simul-color mode select LED 97*d* is switched ON in step S225**. That is, simul-color mode pattern 4 (refer to FIG. 7) is selected.

If it is found in step S223 that simul-color select display LED 97*c* is OFF (i.e., if the result obtained in step S223 is NO), the simul-color mode select display LED 97*d* is switched OFF in step S227, and the simul-color mode is switched OFF. Thereafter, the color select display LED 83 (black) is switched ON, and color select display LED 84 (red) and LED 85 (yellow) are switched OFF in step S229.

The simul-color mode patterns 1 through 4 (refer to FIG. 7) and normal modes (nonsimul-color modes) are rotatingly switched by means of the previously described process each time the simul-color select key 97 enters the ON EDGE state. The program returns to the main routine thereafter.

FIG. 11 is a flow chart showing the process of the copy operation routine in step S9.

First, in step S301, a determination is made as to whether or not the print key 81 is ON EDGE.

When the ON EDGE state of print key 81 is not detected in step S301, the routine jumps steps S303 and S305 and progresses to step S307. On the other hand, when the ON EDGE state of print key 81 is detected in step S301, scanning of the original document is started in step S303, then timers $T_A$ and $T_B$ are started in step S305. Timer $T_A$ regulates the time from print key 81 entering the ON EDGE state until the first developing device 6*a* is switched ON in accordance with the leading edge of the image. Similarly, timer $T_B$ regulates the time from print key 81 entering the ON EDGE state until the second developing device 6*b* is switched ON in accordance with the leading edge of the image.

In step S307 a determination is made as to whether or not LEDs 97*a* or 97*c*, which indicate simul-color mode patterns 1 and 3 respectively), is switched ON. If one of the aforesaid LEDs 97*a* or 97*c* is ON, the simul-color process I described later is executed in step S309. If both the aforesaid LEDs 97*a* and 97*c* are found to be OFF in step S307, then in step S311 it is determined that either LED 97*b* or 97*d*, which indicate simul-color mode patterns 2 and 4, is ON. If the result obtained in step S311 is YES, then simul-color process II described later is executed in step S313; if the result in step S311 is NO, the normal copy process is implemented in step S315.

When simul-color processes I and II are executed, then an end process is executed in step S317 to reset each flag and the like, and the program returns to the main routine.

Figure 12:
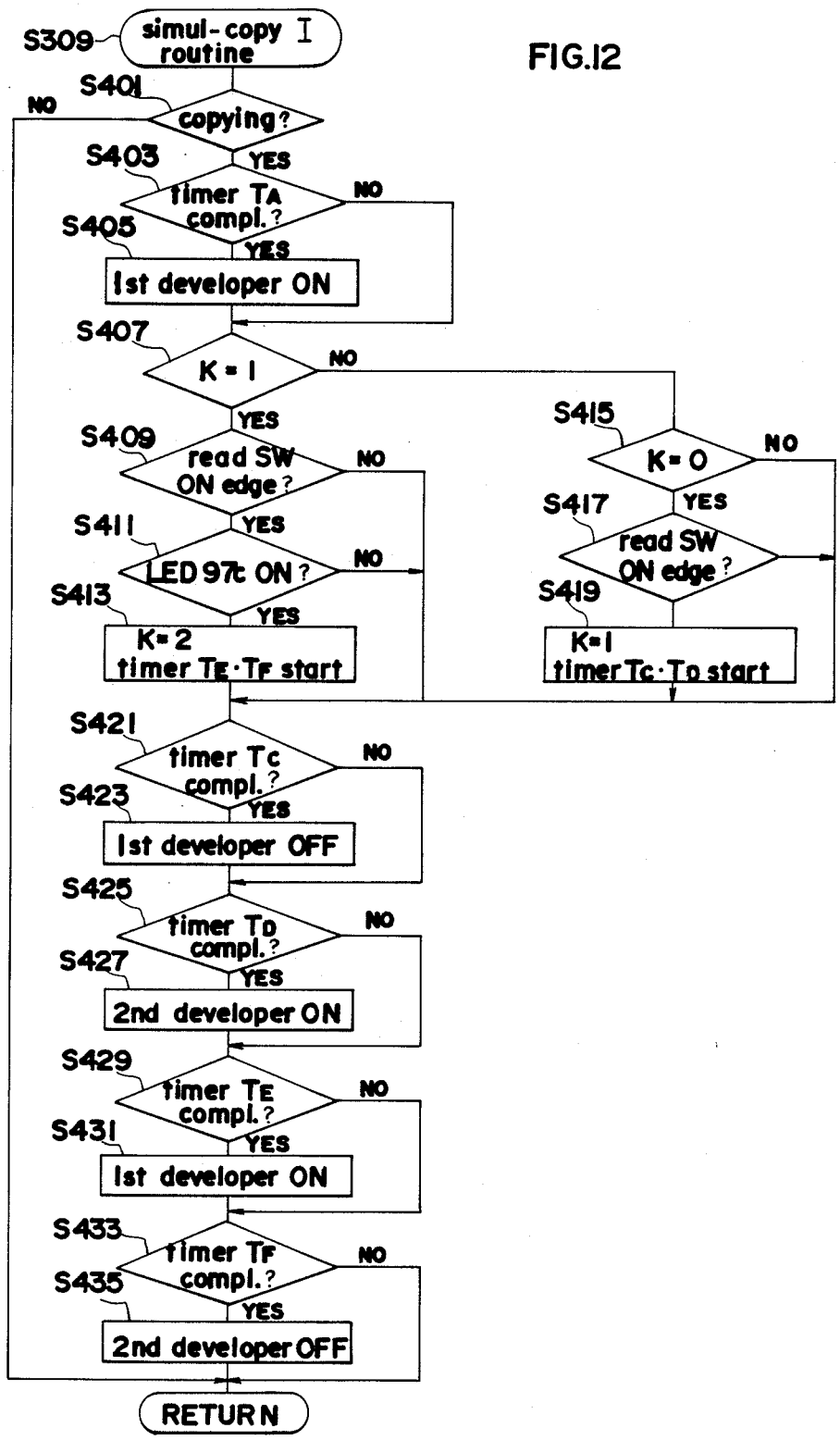
FIG. 12 is a flow chart for the simul-color copy routine I.

FIG. 12 is a flow chart showing the process of the aforesaid simul-color process I in step S309.

First, in step S401, a check is made to determine if the copy operation is in progress, and if not the program returns to the main routine. If the copy operation is found to be in progress, the routine continues to step S403.

In step S403 a determination is made as to whether or not timer $T_A$ is completed. If timer $T_A$ is completed, then first developing device 6*a* is switched ON in step S405. If timer $T_A$ is not completed, then the routine jumps step S405 and progresses to step S407. In step S407, it is determined whether or not counter K has incremented to 1, said counter K indicating the frequency with which reed switch SW110 switches ON in a single scan. If counter K registers 1, then reed switch SW110 is checked in step S409 to determine if it is ON EDGE, and if reed switch SW110 is ON EDGE, LED 97*c* is checked in step S411 to determine whether or not it is switched ON. If LED 97*c* is found to be switched ON, counter K is incremented to 2 in step S413, and timers $T_E$ and $T_F$ are started. If LED 97*c* is found to be ON in step S411, the routine jumps to step S421. Additionally, the routine also jumps to step S421 if reed switch SW110 is found to be OFF EDGE in step S409.

On the other hand, if counter K does not register 1 in step S407, a check is made in step S415 to determine whether or not said counter K registers 0 (zero). If counter K does register 0 (zero), a check is made in step S417 to determine if reed switch SW110 is ON EDGE, and if ON EDGE status is detected, counter K is incremented to 1 in step S419 and timers $T_C$ and $T_D$ are started. When counter K does not register 0 (zero) in step S415, and when ON EDGE status is not detected in step S417, the routine jumps to step S421.

Timers $T_C$ and $T_E$ regulate the time from reed switch SW110 entering the ON EDGE state until the second developing device 6*b* operating state is switched.

Steps S421 through 435 relate to checks to determine whether or not timers $T_C$, $T_D$, $T_E$ and $T_F$ have completed their respective time periods, and processes to switch the operating state of each developing device. That is, the first developing device is switched OFF if timer $T_C$ has completed its time period, the second developing device is switched ON if timer $T_D$ has completed its time period, the first developing device is switched ON if timer $T_E$ has completed its time period, and the second developing device is switched OFF if timer $T_F$ is completed its time period. Thereafter, the program returns to the main routine.

The process described above cannot end if the timers are not started.

Figure 13:
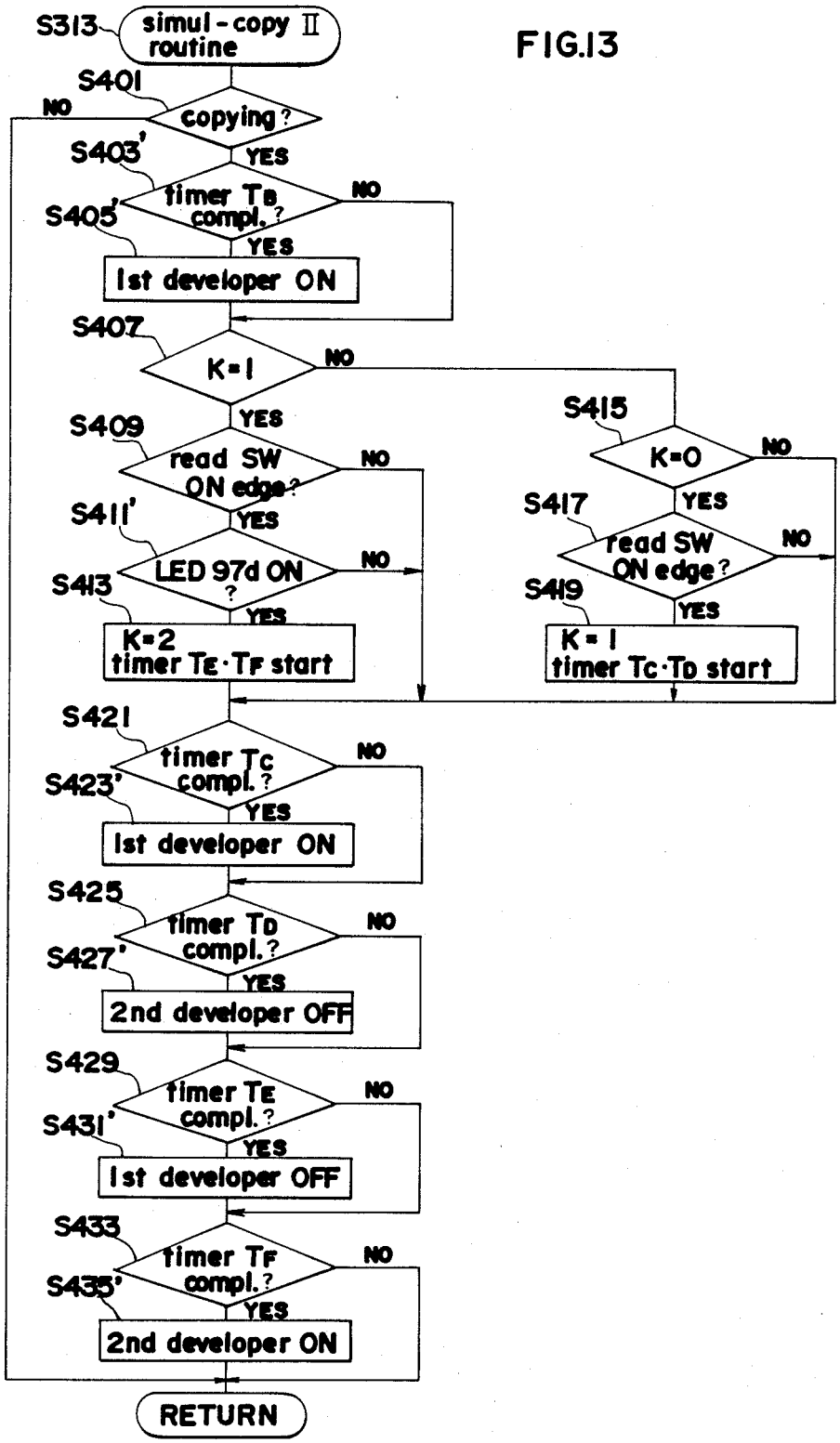
FIG. 13 is a flow chart for the simul-color copy routine II.
Figure 14:
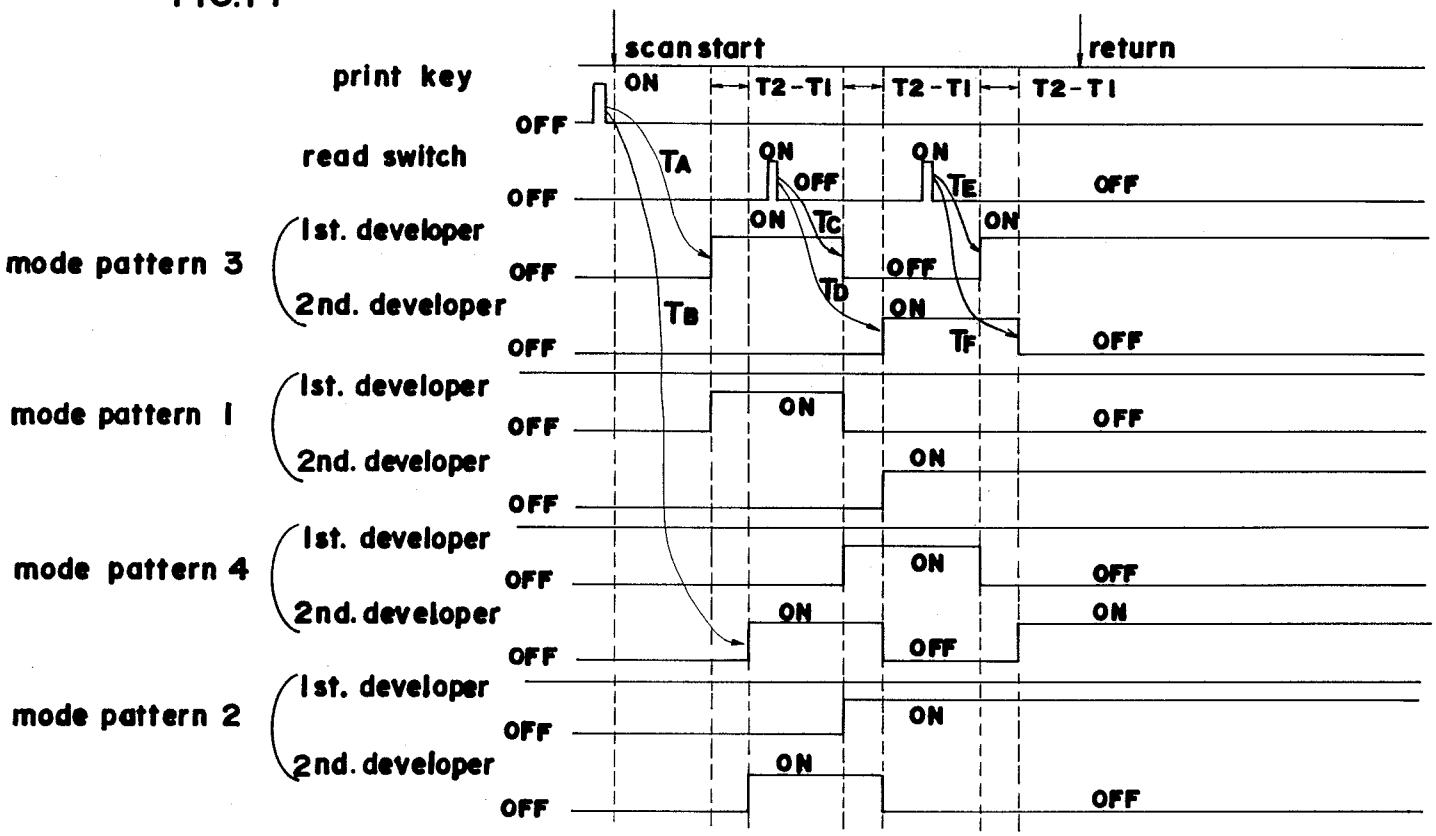
FIG. 14 is a timing chart showing the timing for developing device switching during simul-color copying.

FIG. 13 is a flow chart showing the process of the simul-color process II in step S313.

The process illustrated in the flow chart of FIG. 13 is substantially the same as that of the previously described simul-color process I, with the exception that in simul-color process I the second developing device is switched ON first, while in the aforesaid simul-color process I the first developing device is switched ON first. Identical steps in simul-color processes I and II are designated by identical reference numbers in the drawings, while steps with minor modifications in process II are designated by appending ′ (prime) to the step number.

According to the present invention, when, for example, the image region is subdivided into three smaller regions by a region input means or the region-subdivision mode is set by a simul-color mode input means as described in the previously explained embodiment, two of the three small region may be combined according to specific rules so as to effectively allow two small regions to be set.

Accordingly, the simul-color mode patterns can be easily set, and the previously described disadvantages of conventional devices are eliminated.

In the present invention, the electrostatic latent image was described as being obtained in a single exposure process and was subsequently developed by a plurality of developing devices containing different colored toners so as to produce a simul-color reproduction in a plurality of colors. However, the point of the present invention as previously mentioned, is that the present invention provides a means for invalidating several of the plurality of designating means so as to achieve agreement between the number of regions specified by the specifying means and the number of the regions subdivided by the designating means when these numbers do not agree. Accordingly, the present invention is not limited to the present embodiment, but also pertains to the reproduction process in each region and as such includes a process for erasing an image or other process. The present invention executes a reproduction process for each region in a single-cycle copy process, and is suitable for reproduction methods which produce composite images on the same copy sheet.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being contained therein.

What is claimed is:

1. An image forming apparatus for conducting different copy processes for each of a plurality of regions which are subdivided from one original document relative to document scanning direction, comprising:

a plurality of designating means for assigning boundaries of each region perpendicular to the document scanning direction so as to subdivide the original document into said plurality of regions;

specifying means for specifying a number of regions and pattern of the copy process executed in each region; and means for invalidating at least one of the plurality of designating means so as to achieve agreement between the number of regions specified by the specifying means and the number of the regions subdivided by the designating means when these numbers do not agree.

2. An image forming apparatus of claim 1, wherein said plurality of designating means include a plurality of levers slidably arranged along the document scanning direction.

3. An image forming apparatus of claim 2, wherein one of said plurality of levers has different size from the remaining lever.

4. An image forming apparatus of claim 2, wherein one of said plurality of levers has different color from the remaining lever.

5. An image forming apparatus of claim 1, wherein said specifying means includes a key member to specify the number of regions and the pattern of the copy process.

6. An image forming apparatus for conducting different copy processes for each of a plurality of regions which are subdivided from one original document relative to document scanning direction, comprising:

a plurality of developing means each having a developer of different colors;

a plurality of designating means for assigning boundaries of each region perpendicular to the document scanning direction so as to subdivide the original document into said plurality of regions;

specifying means for specifying a number of regions and pattern of the copy process executed in each region, wherein said pattern of the copy process specifies a particular color to develop an image of each region; and means for invalidating at least one of the plurality of designating means so as to achieve agreement between the number of regions specified by the specifying means and the number of the regions subdivided by the designating means when these numbers do not agree.

7. An image forming apparatus of claim 6, wherein said plurality of designating means include a plurality of levers slidably arranged along the document scanning direction.

8. An image forming apparatus of claim 7, wherein one of said plurality of levers has different size from the remaining lever.

9. An image forming apparatus of claim 7, wherein one of said plurality of levers has different color from the remaining lever.

10. An image forming apparatus of claim 6, wherein said specifying means includes a key member to specify the number of regions and the pattern of the copy process.

11. An image forming apparatus for conducting different copy processes for each of a plurality of regions which are subdivided from one original document relative to document scanning direction, comprising:

a plurality of developing means each having a developer of different colors;

a plurality of designating means for assigning boundaries of each region perpendicular to the document scanning direction so as to subdivide the original document into said plurality of regions;

a copying control means for selectively switching and actuating the plurality of developing means in correspondence with the boundary assigned by the designating means, thereby to accomplish multicolor copying during one cycle of copying operation;

specifying means for specifying a number of regions and pattern of the copy process executed in each region; and means for invalidating at least one of the plurality of designating means so as to achieve agreement between the number of regions specified by the specifying means and the number of the regions subdivided by the designating means when these numbers do not agree.

12. An image forming apparatus of claim 11, wherein said plurality and designating means include a plurality of levers slidably arranged along the document scanning direction.

13. An image forming apparatus of claim 12, wherein one of said plurality of levers has different size from the remaining lever.

14. An image forming apparatus of claim 12, wherein one of said plurality of levers has different color from the remaining lever.

15. An image forming apparatus of claim 11, wherein said specifying means includes a key member to specify the number of regions and the pattern of the copy process.

16. An image forming apparatus having a plurality of developing units including developers having different color toner and for accomplishing a multi-color copying during one cycle of copying operation by selectively switching and actuating the plurality of developing units, comprising:

a plurality of designating means for assigning boundaries of each region perpendicular to the document scanning direction so as to subdivide the original document into said plurality of regions;

specifying means for specifying a number of regions and pattern to be used for each region; and means for invalidating at least one of the plurality of designating means so as to achieve agreement between the number of regions specified by the specifying means and the number of the regions subdivided by the designating means when these numbers do not agree.

17. An image forming apparatus of claim 16, wherein said plurality of designating means include a plurality of levers slidably arranged along the document scanning direction.

18. An image forming apparatus of claim 17, wherein one of said plurality of levers has different size from the remaining lever.

19. An image forming apparatus of claim 17, wherein one of said plurality of levers has different color from the remaining lever.

20. An image forming apparatus of claim 16, wherein said specifying means includes a key member to specify the number of regions and the pattern of the copy process.

* * * * *